US008807223B2

(12) United States Patent
Smith

(10) Patent No.: US 8,807,223 B2
(45) Date of Patent: Aug. 19, 2014

(54) METHOD AND APPARATUS TO CONTROL FLUID FLOW FROM SUBSEA WELLS

(75) Inventor: David R. Smith, Midland, TX (US)

(73) Assignee: David Randolph Smith, Midland, TX (US)

( * ) Notice: Subject to any disclaimer, the term of this patent is extended or adjusted under 35 U.S.C. 154(b) by 0 days.

(21) Appl. No.: 13/118,064

(22) Filed: May 27, 2011

(65) Prior Publication Data

US 2011/0290495 A1 Dec. 1, 2011

Related U.S. Application Data

(60) Provisional application No. 61/349,620, filed on May 28, 2010.

(51) Int. Cl.
*E21B 43/013* (2006.01)

(52) U.S. Cl.
USPC ..... 166/335; 166/339; 166/344; 166/345; 166/363; 166/364

(58) Field of Classification Search
USPC ..... 166/335, 339, 344, 345, 347, 363, 364, 166/366, 367, 313, 386, 85.4, 85.5, 89.2, 166/270
See application file for complete search history.

(56) References Cited

U.S. PATENT DOCUMENTS

| | | | | |
|---|---|---|---|---|
| 2,609,836 A | | 9/1952 | Knox | |
| 3,064,735 A | * | 11/1962 | Bauer et al. | 166/340 |
| 3,139,932 A | * | 7/1964 | Johnson | 166/368 |
| 3,265,130 A | | 8/1966 | Watkins | |
| 3,332,493 A | | 7/1967 | Jones et al. | |
| 3,482,601 A | * | 12/1969 | Drouin | 137/876 |
| 3,599,711 A | * | 8/1971 | Fowler | 166/335 |
| 4,116,272 A | | 9/1978 | Barrington | |
| 4,130,161 A | * | 12/1978 | Jones | 166/337 |
| 4,147,221 A | | 4/1979 | Ilfrey et al. | |
| 4,234,047 A | | 11/1980 | Mott | |
| 4,266,889 A | * | 5/1981 | Rail et al. | 405/223 |
| 4,624,318 A | | 11/1986 | Aagaard | |
| 4,626,135 A | | 12/1986 | Roche | |
| 4,796,922 A | | 1/1989 | Prichard | |
| 4,819,730 A | * | 4/1989 | Williford et al. | 166/355 |
| 4,969,519 A | | 11/1990 | Kelly | |
| 5,146,990 A | | 9/1992 | Ritter, Jr. | |

(Continued)

FOREIGN PATENT DOCUMENTS

WO WO-2008/154486 A2 12/2008

OTHER PUBLICATIONS

International Search Report and Written Opinion of PCT/US11/38418 mailed Oct. 19, 2011, 20 pages.

(Continued)

*Primary Examiner* — James Sayre
(74) *Attorney, Agent, or Firm* — Fulbright & Jaworski LLP

(57) ABSTRACT

The present invention is directed to methods and apparatus to construct subsea wells with redundant parallel fluid flow control systems to allow new methods to stop subsea blow outs. More specifically, this invention provides methods and apparatus to construct subsea wells with a plurality of redundant parallel paths allowing for the first time drill pipe and other intervention conduits, wire line, and fluids to be deployed below a damaged drilling riser and or a damaged blow out preventer through a separate blow out preventer and riser system presented in this invention.

7 Claims, 4 Drawing Sheets

(56) References Cited

U.S. PATENT DOCUMENTS

| | | | | |
|---|---|---|---|---|
| 5,284,210 | A * | 2/1994 | Helms et al. | 166/385 |
| 5,676,209 | A | 10/1997 | Reynolds | |
| 5,875,848 | A | 3/1999 | Wolff et al. | |
| 6,227,300 | B1 | 5/2001 | Cunningham et al. | |
| 6,408,947 | B1 | 6/2002 | Cunningham et al. | |
| 6,422,315 | B1 | 7/2002 | Dean | |
| 6,497,286 | B1 * | 12/2002 | Hopper | 166/368 |
| 6,520,262 | B2 * | 2/2003 | Barnett et al. | 166/367 |
| 6,622,799 | B2 | 9/2003 | Dean | |
| 6,715,554 | B1 | 4/2004 | Cunningham et al. | |
| 6,745,857 | B2 | 6/2004 | Gjedebo | |
| 6,968,902 | B2 | 11/2005 | Fenton et al. | |
| 7,063,157 | B2 | 6/2006 | Bartlett | |
| 7,134,498 | B2 | 11/2006 | Hopper | |
| 7,143,830 | B2 | 12/2006 | Bartlett | |
| 7,165,610 | B2 | 1/2007 | Hopper | |
| 7,216,714 | B2 | 5/2007 | Reynolds | |
| 7,216,715 | B2 | 5/2007 | Reynolds | |
| 7,222,674 | B2 | 5/2007 | Reynolds | |
| 7,690,433 | B2 | 4/2010 | Reynolds | |
| 7,921,917 | B2 | 4/2011 | Kotrla et al. | |
| 8,365,830 | B2 | 2/2013 | Kotrla et al. | |
| 2002/0066597 | A1 * | 6/2002 | Schubert et al. | 175/38 |
| 2006/0191716 | A1 * | 8/2006 | Humphreys | 175/5 |
| 2007/0163782 | A1 | 7/2007 | Keener | |

OTHER PUBLICATIONS

International Preliminary Report on Patentability of International Application PCT/US2011/038418 mailed Dec. 4, 2012.

* cited by examiner

METHOD AND APPARATUS TO CONTROL FLUID FLOW FROM SUBSEA WELLS

CROSS-REFERENCE TO RELATED APPLICATIONS

This application claims the benefit of U.S. Provisional Patent Application Ser. No. 61/349,620, filed on May 28, 2010.

TECHNICAL FIELD

The present disclosure is directed to methods and apparatus to control fluid flows from subsea wells. This disclosure teaches subsea methods and apparatuses that provide a redundant and contingency hydraulically sealed path from surface to subsea wells for well fluids, well tubulars, wire line, bits, logging tools, and other well tools during subsea drilling, subsea completing, and other subsea well operations that require well fluid control. More specifically, this invention teaches a multi path to enter subsea wells through fluid flow control systems of subsea wells. Furthermore, the invention teaches multiple marine riser conduits paths that have a common subsea wellhead entry path.

BACKGROUND OF THE INVENTION

When a well is drilled in a subsea environment the ability to repair, remove, or maintain the industry standard well control device, the Blow Out Preventer, BOP, is challenged due to the fact that it is on the seafloor. As mankind continues to drill wells in ever deeper water depths the BOP system may be miles below the sea surface.

The subsea BOP currently used by the industry is further compromised or challenged by the large riser pipe that can be several feet in diameter, miles long, and have a weight of millions of pounds being mounted on top of the BOP stack and proceeding to the surface. This large riser is used to allow return fluids from drilling the well to flow from the subsea well head to the surface through the BOP If the riser pipe fails then there is no path to get drill pipe or kill fluids into the subsea well. If the riser pipe fails, and the B.O.P.s fail during a blow out, like it did in the 2010 Gulf of Mexico blowout, then there is no method to get drill pipe into the well and kill the well with heavy fluid to stop the fluid from erupting from the well. Embodiments of this invention are methods and apparatus to avoid failed risers and BOPs by constructing an alternative path to the subsea well that is not encumbered by the previously failed BOP, failed risers, or foreign debris lodged in the BOP The current industry methods teach towards making the subsea BOP system reliable by stacking in a plurality of closure devices all in the same axis in a BOP stack, and to continually test the BOPs. However, if the BOP fails during a blow out, for example foreign object and debris like a large piece of earth or previously disposed casing or wellhead are pushed up into the BOP the BOP will not close and the foreign debris that is lodged in the BOP can also prevent the entry of fluid or drill pipe from surface to enter in the well to control the blowout. What is needed is an alternative path to the subsea well from surface that is unencumbered by the primary path. What is further needed is a method that presents an alternative path through drilling risers, and subsea BOPs and that allows a parallel subsea BOP stack and riser to be offset from the primary path and the first flow path axis of subsea BOPs and riser to a subsea well.

The current subsea industry is further challenged by the need to drill in ever deeper water depths and ever deeper subterranean depths below the subsea floor. A problem presents itself in deep water depths where the force that the sea depth places on the earth is less than the force that the overburden of the earth would places on subterranean formations. This results in the subterranean rock hydraulic fracture pressure of deep water offshore wells being lower than deep wells drilled from land. The drilling fluid hydrostatic pressure of the deep water wells weighted drilling fluid has a down hole hydrostatic pressure increased by the vertical height of the subsea wells seafloor depth to the surface of the sea. What is needed is a means to have the drilling mud from the sea floor, to the bottom of the well where the drill bit is cutting at a higher density, and the density of the drilling fluid between the outer diameter of the drill pipe and the internal diameter of the riser from the sea floor to the surface to have a lighter density. Embodiments of the invention allow for such a dual gradient drilling fluid means to be achieved by pumping through a second BOP conduit a lighter fluid and mixing it below the B.O.Ps to create a lighter fluid hydrostatic from the seafloor to the surface in the drilling riser. This then allows wells to be drilled safer as the risk of lost circulation due to hydraulic fracturing of the subterranean rocks due to the combination of hydrostatic forces developed by heavy drilling fluids and drilling cuttings in the casing and open hole in addition to the hydrostatic forces of the drilling fluids and cuttings on the outer diameter of the drill pipe and the internal diameter of the drilling riser has been reduced.

BRIEF SUMMARY OF THE INVENTION

Various embodiments of the invention include new well construction methods and procedures and apparatus to assure that subsea wells can be drilled with redundant subsea flow control systems making subsea drilling safer and less likely to cause massive contamination to the oceans and seas of the world.

In one embodiments of the invention there is a new method of well construction that results in a redundant and separate well control path for drill pipe, wire line, and fluid injection to bypass damaged risers and subsea blow out preventers.

Various embodiments of the invention include methods and apparatus that will allow man to more safely produce subsea hydrocarbons using a redundant path riser and subsea BOP method.

In yet another embodiment, a method is taught where a dual gradient drilling fluid system can be achieved where the fluid gradient in the drill pipe outer diameter in the drilling riser is lower than the fluid gradient in the casing and well bore below the sea floor thusly allowing subsea wells to be drilled with less risk of hydraulically fracturing the subterranean rock, losing drilling fluid, subsequently losing the hydrostatic force to control the fluid from the well and resulting in a blowout. This method of lightening the fluid hydrostatic in the riser can also be used in the art of primary cementing a casing in a subsea well thereby also reducing the down hole hydrostatic forces on the subterranean well bore during cement placement and cement cure time. This lightening method is achieved by having at least two separate fluid and drill pipe flow paths from surface to the subsea wellhead each having subsea BOP systems with different risers but a common mixing point below the respective risers B.O.Ps and injecting a lighter fluid down one flow path and taking returns of drilling fluids, cuttings, or cement, and lighter fluid up a riser. In an embodiment of the invention, the multi-path apparatus comprises at least two separate continuous paths to the surface.

In one embodiment of the invention there is a method for the construction of a subsea well comprising connecting the distal end of a subsea multi-path apparatus to the subsea well wherein the subsea multi-path apparatus comprises at least two separate paths each comprising separate proximal ends converging to the common distal end of the subsea well; connecting at least one subsea closure apparatus to a proximal end of the subsea multipath apparatus; connecting a distal end of a riser conduit apparatus to the subsea closure apparatus wherein the riser has the proximal end at or near the surface of the sea: and hydraulically sealing all connections of the subsea wellhead, subsea multipath apparatus, subsea closure apparatus, and riser forming a continuous sealed hydraulic conduit from surface to the subsea wellhead. The subsea closure apparatus may additionally comprise a blow out preventer system. In a specific embodiment of the invention, the subsea multipath apparatus is deployed to the subsea well before the subsea closure apparatus. Additionally, the riser conduit apparatus may comprise a drilling riser apparatus. The method may further comprise the step of deploying a pipe from a rig at the surface through the continuous sealed hydraulic conduit into the subsea well. A second multi-path apparatus may be connected to a proximal end of the subsea multi-path apparatus, forming two attached multi-path apparatus.

Other embodiments of the invention is a method of controlling the fluid flow from a subsea well comprising connecting at least two separate subsea blowout apparatus to different proximal end branches of a subsea multi-path apparatus comprising at least two proximal ends converging to a common distal end; connecting to the respective proximal end of at least one of the at least two separate subsea blowout apparatus to at least one riser conduit wherein the riser conduit has a proximal end at the surface; inserting at least one continuous injection conduit having a proximal end at the surface into at least one of the riser conduit; pumping fluids from the surface of into the subsea well through at the least one continuous conduit having a proximal end at the surface. In a specific embodiment of the invention different fluids are injected down at least two separate injection conduits inserted in at least two separate riser conduits through separate subsea blowout apparatus with the pumping from surface of the fluids. In certain cases, a lighter fluid is pumped down the a separate injection fluid conduit mixed at the discharge distal end of the multi-path apparatus with fluids coming from the well.

The embodiment above may also include attaching a drill bit and down hole assembly to the continuous conduit; deploying the continuous conduit through the subsea blow out preventer and the multi-passage apparatus; setting the drill assembly and weight of continuous conduit down in the well; rotating the drilling assembly and cutting earth; pumping a drilling fluid through the continuous conduit and the drilling assembly; returning the drilling fluid with earth cuttings to the surface through the multi-path assembly, blow out preventer, and riser conduit; mixing and returning the second fluid with the first fluid and earth cuttings up the riser conduit to surface. In a specific embodiment of the invention, the second fluid has a lower fluid density than the first fluid. The second fluid may also have a higher viscosity than the first fluid.

An additional embodiment of the invention is a multipath subsea apparatus comprising a subsea spool containing at least two proximal ends where the at least two proximal ends intersect forming a common exit pathway at or above the distal end of the subsea multipath apparatus. The apparatus may further comprise mechanical connector means on the proximal and distal ends adapted to form hydraulic seals with connected devices and apparatus. Additionally, hydraulic seals may be formed using elastomeric or metal to metal seals. The multipath subsea apparatus may also comprises at least one subsea closure device, such as a gate valve. A specific embodiment of the invention further comprises a blow out preventer that may be located on any one or more of the proximal ends of the apparatus. The apparatus may further comprise a riser conduit connector and release apparatus attached to at least one of the proximal ends of the subsea multipath apparatus.

Another embodiment of the invention is a multiple access subsea system comprising a subsea spool containing at least two proximal ends where the at least two proximal ends intersect forming a common exit pathway at or above the distal end of the subsea multipath apparatus. The system may further comprise mechanical connector means on the proximal and distal ends which form hydraulic seals with connected devices and apparatus. Additionally, hydraulic seals may be formed using elastomeric or metal to metal seals. The system may also comprises at least one subsea closure device, such as a gate valve. A specific embodiment of the invention further comprises a blow out preventer that may be located on any one or more of the proximal ends of the apparatus. The system may further comprise a riser conduit connector and release apparatus attached to at least one of the proximal ends of the subsea multipath apparatus. The system may also form a hydraulic seal from the surface down to the subsea well.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

As used herein, "a" or "an" means one or more. Unless otherwise indicated, the singular contains the plural and the plural contains the singular. Where the disclosure refers to "perforations" it should be understood to mean "one or more perforations".

As used herein, "surface" refers to locations at or above the surface of body of waters surface. The body of water can be a sea, ocean, lake, or ice body.

As used herein, "proximal" refers to the position closer to the surface of the sea.

As used herein, "distal" refers to a position that is in the opposite direction of the proximal position.

As used herein, "spool" refers to a structural body of a well having connection positions on the distal end and the proximal end and comprising at least one passage through said body.

As used herein, a "Blow Out Preventer" stack or BOP refers to devices used to control the fluid flow from wells. BOP systems encompasses many configurations and arrangements of closure devices including but not limited to annular bags, shear rams, pipe rams, and various hydraulic and electrical devices used to actuate and control the B.O.P stack.

As used herein, a "back pressure valve" refers to a device that allows fluid to flow in only one direction. This device when placed in a well casing is sometimes known in the oil and gas grouting and cementing business as a float collar or float shore, wherein said back pressure valve is inserted into a piece of casing having, normally fixed with a cured cement grout, having threads on either end of said casing and the inserted into and near the bottom of a well casing string as it is deployed in a well such that fluids can be pumed down the casing but fluids from outside the casing cannot flow into the casing.

As used herein "connected" includes physical, whether direct or indirect, permanently affixed or adjustably mounted connections. Thus, unless specified, "connected" is intended to embrace any operationally functional connection.

Figure 1:
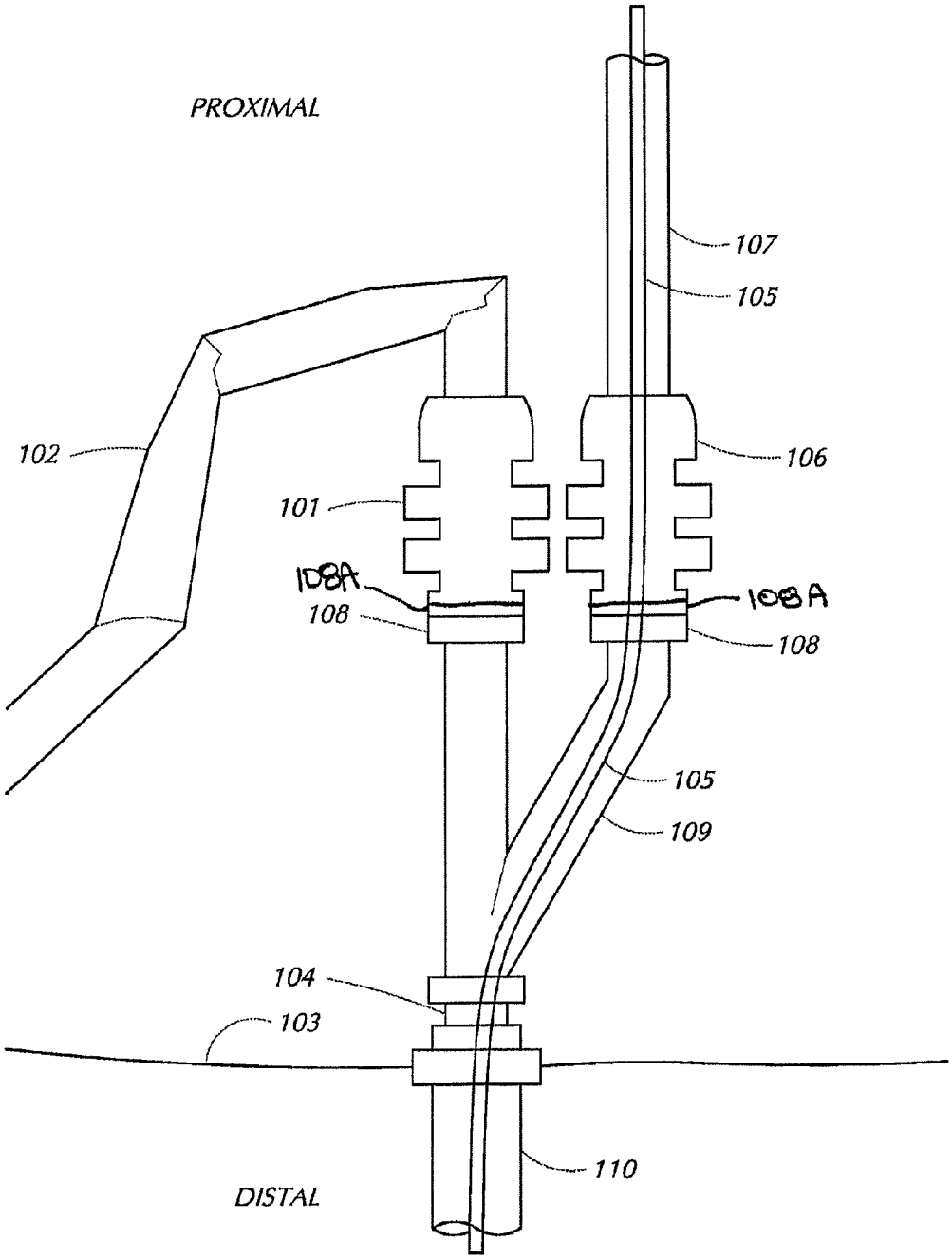
FIG. 1 illustrates a subsea well with a damaged marine riser blowing out fluids whilst this inventions redundant well control system is allows a secondary Blow Out Preventer, BOP and marine riser to deploy tubing into the subsea well to control and stop the blow out.

Referring to FIG. 1, presents a subsea well system that has had a subsea blow out. FIG. 1 further presents a novel new multipath apparatus 109 being predisposed on a subsea well head 104 being at the seafloor 103. Well casing 110 is shown being below the sea floor 103 and proceeds to subterranean depths where reservoir fluids are erupting upward though the failed BOP 101. The subsea well system in FIG. 1 shows a failure of the marine riser 102, which is shown in FIG. 1 as having fallen down from its normal surface proximal termination point on a drilling rig down into the sea. The first drilling Blow Out Preventer, BOP stack, 101 has failed to close in the subsea well fluid flows.

A BOP may have many combinations of various closure apparatus designed to stop fluid flow from wells such as annular bags, pipe rams, and shear rams and in subsea applications they are deployed with various connectors, actuators, and controllers. Due to the difficulty of the environment of subsea wells and the great risk to the environment the current practices is to deploy a plurality of these closure devices subsea such that they form a stack formed by connecting one upon the other for redundancy. The current industry teaches toward stacking these closure devices in combinations, one on top of the other, in various sequences. FIG. 1 depicts a new method of constructing a completely independent path to the wellhead 104 that avoids the damage of BOP 101 and riser 102. Furthermore, this invention method teaches deploying a second BOP system 106 with a riser 107 connected to the multipath apparatus 109 and disposing a drill pipe 105 through the riser 107, BOP 106, multipath apparatus 109, wellhead 104 and into the well. The drill pipe 105 then allows the pumping of a fluid from the surface form a drilling rig or service supply vessel into the well killing the well blow out by the addition of this fluids hydrostatic weight.

This failure of the BOP 101 shown in FIG. 1 can be caused by a variety of reasons, including but not limited to mechanical failure, electrical failure, hydraulic failure of the various devices in the BOP 101 system, failure in human procedures to construct the BOP 101, poor maintenance of BOP 101, and a previous casing disposed in the well moving up through the BOP 101, resulting in fluid flowing up the well casing 110 through the wellhead 104. In all the failure modes the result is that the BOP 101 does not have the ability to close in the well fluid flows. This embodiment allows the blow out well to be killed as the method teaches to predispose a multipath apparatus 109 on subsea wellhead 104.

The failure of the riser 102 depicted in FIG. 1 can be caused by a variety of reasons, including but not limited to mechanical failures, ocean currents, storms, failure of riser latching systems, and human error. A method taught herein of predisposing at least one multipath apparatus for drill pipe 105 to be deployed below the damaged BOPs 101 and damaged riser 102. This redundant path from the surface through riser 107, BOP 106, and a multipath apparatus 109 to the wellhead 104 avoids obstructions of riser 102 or BOP 101, allows removal of any obstruction, allows the milling out of obstructions, and allows the pumping of fluids through a functional and redundant BOP 106 in the well. The proximal end 108 of the multipath apparatus is attached to the BOP and the well head through hydraulic seals 108A such as elastomeric and/or metal to metal seals. Using hydraulic seals in connections between the wellhead and the riser at the surface creates a fluid tight connection protecting the outside environment from fluid leakages whilst also building a passage for conduits, fluids, wireline, from the surface into the subsea well.

Figure 2:
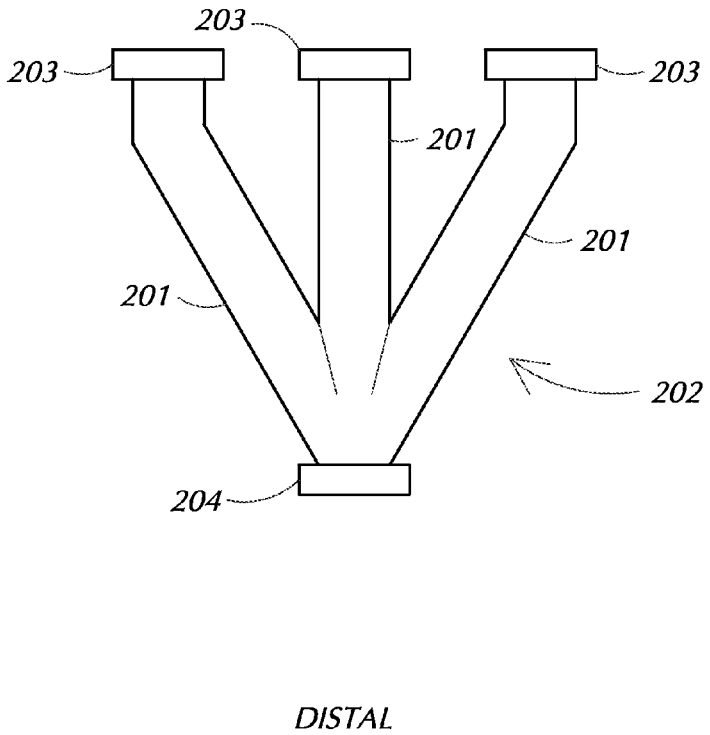
FIG. 2 illustrates this inventions subsea wellhead spool piece having a plurality of proximal entry paths with a common distal exit path.

Referring to FIG. 2, a new subsea apparatus is depicted and referred to herein as a multipath apparatus that has at least two entry ports 203 at the proximal end having a common exit path at the distal end 204. The invention teaches to predispose the multipath apparatus 202 on a subsea well head. The apparatus 202 can be connected to the wellhead directly or to a wellhead hydraulic connector apparatus disposed on top of the wellhead. In either case the method of predisposing the multipath apparatus 202 prior to disposing BOP stacks is a new construction method thereby providing a heretofore never know redundant path BOP system to the wellhead. The method then teaches to connect the multipath apparatus 202 shown in FIG. 2 on the distal end to a wellhead and the entry ports 203 at a proximal end to subsea BOP systems and the distal ends of these BOP systems to riser that have their proximal end at the surface. Redundant BOPs and redundant risers can be connected in advance of a blow out and failure of the primary BOPs and riser, or can be deployed after a blow out and failure of the primary BOP and riser system using known rig and remote operated submersible vehicle methods. However, the multipath apparatus is predisposing prior to any BOP system on to the subsea wellhead system.

Referring FIG. 2, the new subsea multipath apparatus 202 has at least two branches 201 that have an internal diameter sufficient to allow the passage of drill pipe, drill pipe down hole assemblies like drilling motors, drill collars, drilling bits, a various directional tools.

FIG. 2 depicts a multipath apparatus having three entry ports 203 at the proximal end. It is clear that the multipath apparatus can have many multipath apparatus ports and resulting branches 201.

Figure 3:
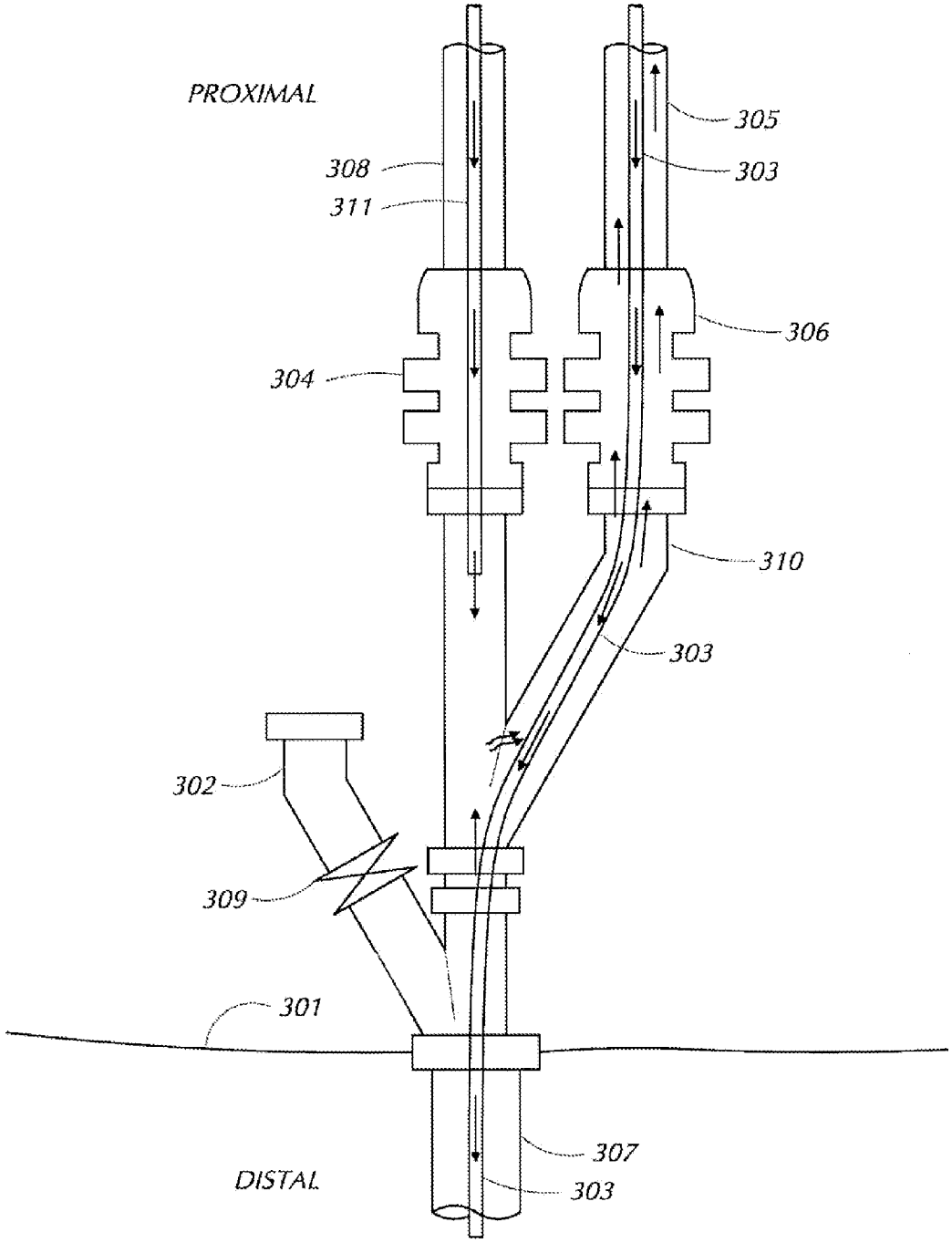
FIG. 3 shows a general configuration of this inventions subsea redundant path BOP deployed to allow dual gradient drilling where a heavy drilling fluid is pumped through a drill pipe and the fluid is mixed with a lighter second fluid below the BOPs and lifted to surface through a marine riser.

FIG. 3 illustrates another embodiment of the invention. FIG. 3, depicts subsea well penetrating the seafloor 301 having more than one subsea multipath apparatus 302 and 310. Apparatus 302 has a subsea gate valve 309 to allow for it to be opened and closed. Those familiar with the art of subsea operations may well want to include a plurality of valves like 309 and the valves can be operated by many means known to those familiar with the art of subsea drilling including remotely operated vehicles. FIG. 3 presents a method of changing the fluid characteristics of the returning well fluids by mixing fluid pumped from the surface down drill pipe 303 disposed in riser 305 with fluid being pumped down a second fluid conduit deployed from surface inside riser 308. The hydrostatic force of the fluid column in the well casing 307 can be reduced by pumping riser 308 fluid that has a lower density than riser 305 fluid, and mixing the two fluids in the subsea multipath apparatus 302 and allowing the mixed fluids to rise through the BOP 306 through the riser 305 to surface. The BOP 304 can close the annulus fluid path between the conduit inside of it and riser 308, thereby forcing the lighter fluid of riser 308 to mix with the well fluid being pumped from surface down the drill pipe 303 and the combined fluids flow up to surface through BOP 306 through the riser 305.

Referring to FIG. 3 the viscosity and hence the riser fluid's ability to carry solids and earth cuttings to the surface can be enhanced by injecting a viscosifying fluid as the second fluid down the continuous conduit 311 deployed from surface through riser 308 and mixing in the subsea multipath apparatus 310 with the first fluid coming from the well wherein the first fluid is being pumped from surface through drill pipe 303 and the mixed fluids rising through riser 305. The ability to improve the fluid viscosity of the mixed fluid in riser 305 formed in the subsea multipath apparatus 310 allows for lower viscosity fluids to be pumped from surface down drill pipe 303 which reduces the surface friction pressure for the surface pumps, as the velocity and hence fluid capacity to carry cuttings from the well is higher is often times higher in the well casing 307 by drill pipe 303 annulus than it is in the riser 305.

Figure 4:
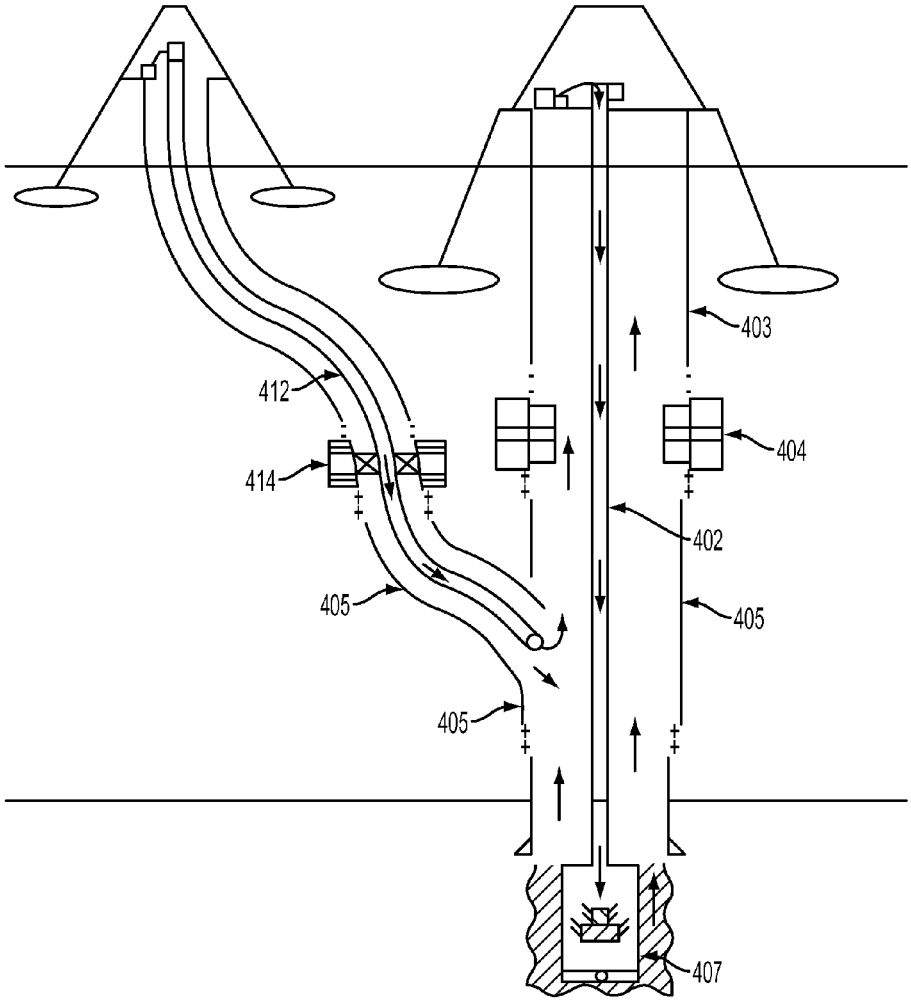
FIG. 4 shows a subsea well hydraulic system for grouting or drilling a subsea well bore.

FIG. 4 shows a subsea well hydraulic system for grouting or drilling a subsea well bore. A method for grouting a subsea well bore may include deploying a well casing 407 comprising a back pressure valve assembly though the seafloor into a subsea well bore. Then, deploying a continuous conduit 412 through at least one BOP 414. Then, pumping a well fluid followed by a grout from the surface down said continuous conduit 412 into said well casing 407 and into the casing outer diameter in said subsea wellbore. Then, displacing with fluids pumped from the surface said continuous conduit 412 inside said casing 407. Then, returning said fluids up the well bore by a casing annulus through said subsea multipath subsea apparatus 405 and riser to the surface. Then, injecting from surface a second fluid down a second continuous conduit 402 having a proximal end at the surface and deployed through a second riser conduit 403, through a second blow out preventer 404, having the distal end of said conduit in or near the multi-path apparatus 405. Then, mixing subsea and returning said second fluid with said first fluid being injected from surface down first continuous conduit 412 up said casing outer diameter in subsea well bore casing wellhead multipath apparatus 405 and riser conduit to surface.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, subsea deployment means, subsea control systems, machine, manufacture, composition of matter, means, methods and steps described in the specification. As one of ordinary skilled in the art will readily appreciate from the disclosure of the present invention, processes, devices, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, devices, manufacture, compositions of matter, means, methods, or steps.

What is claimed is:

1. A method of controlling the fluid flow from a subsea well, comprising:

connecting at least two separate subsea blowout apparatus above different proximal end branches of a subsea multipath apparatus, wherein said multi-path apparatus comprises at least two proximal ends that define separate injection conduits converging to a common distal end;

connecting above the respective proximal end of at least one of said at least two separate subsea blowout apparatus at least one riser conduit wherein said riser conduit has a proximal end at or near the surface;

inserting at least one injection conduit having a proximal end at or near the surface into at least one of said riser conduit;

pumping fluids from the surface into said subsea well through the at least one conduit having a proximal end at the surface and a distal end below the surface, wherein different fluids are injected down the separate injection conduits through the separate subsea blowout apparatuses with said pumping from surface of said fluids.

2. The method of claim 1, comprising:

attaching a drill bit and down hole assembly to the conduit;

deploying said conduit through said subsea blowout apparatus and said multi-passage apparatus;

setting the drill assembly and weight of the injection conduit down in the well;

rotating the drilling assembly and cutting in the well or wellbore;

pumping a drilling fluid through said injection conduit and said drilling assembly;

returning said drilling fluid with drill cuttings to the surface through said multi-path assembly, blow out preventer, and riser conduit;

injecting from surface simultaneously a second fluid down a second injection conduit deployed through a second riser conduit, through a second blow out preventer, and through a proximal end of the multi-path apparatus; and mixing and returning said second fluid with said first fluid and drill cuttings up said riser conduit to surface.

3. The method of claim 2, wherein said second fluid has a lower fluid density than said first fluid.

4. The method of claim 2, wherein said second fluid has a higher viscosity than said first fluid.

5. The method of claim 1, wherein a lighter fluid is pumped down the said at least one separate injection fluid conduit mixed at the discharge distal end of said multi-path apparatus with fluids coming from the well.

6. The method of claim 1, used in grouting a casing in a subsea well, comprising:

deploying a well tubular system injection conduit comprising at least one back pressure valve assembly through the seafloor into a subsea well bore;

deploying said injection conduit through at least one of said at least two separate subsea blowout apparatus;

pumping a well fluid followed by a grout from the surface down said injection conduit into said well casing and into the casing outer diameter in said subsea wellbore;

displacing fluids and grouts disposed inside said injection conduit or casing with fluids pumped from the surface through said injection conduit or casing;

returning said displaced fluids and grouts up the well bore by a casing outside diameter annulus through said subsea multipath subsea BOP and riser to the surface;

injecting from surface a second fluid down a second injection conduit having a proximal end at surface and deployed through a second riser conduit, through a second blow out preventer, having the distal end of said second injection conduit in or near the multi-path apparatus; and mixing subsea and returning said second fluid with said first fluid being injected from surface down first injection conduit to displace well fluids and grout up said casing outer diameter in subsea well bore casing through said subsea wellhead multipath apparatus and riser conduit to surface.

7. The method of claim 6, wherein said second fluid has a lower fluid density than said first fluid.

* * * * *